US009861198B2

(12) United States Patent
Anderson

(10) Patent No.: US 9,861,198 B2
(45) Date of Patent: Jan. 9, 2018

(54) BRACKET TO SUPPORT A SHELF

(71) Applicant: Kevin Anderson, Rexburg, ID (US)

(72) Inventor: Kevin Anderson, Rexburg, ID (US)

(73) Assignee: Kevin Anderson, Rexburg, ID (US)

( * ) Notice: Subject to any disclaimer, the term of this patent is extended or adjusted under 35 U.S.C. 154(b) by 0 days.

(21) Appl. No.: 15/085,613

(22) Filed: Mar. 30, 2016

(65) Prior Publication Data

US 2017/0280873 A1 Oct. 5, 2017

(51) Int. Cl.
*A47B 5/00* (2006.01)
*A47B 96/06* (2006.01)
*A47B 96/02* (2006.01)

(52) U.S. Cl.
CPC ..... *A47B 96/066* (2013.01); *A47B 96/028* (2013.01); *A47B 96/061* (2013.01)

(58) Field of Classification Search
USPC ..... 248/235, 239, 241, 247, 250, 224.7; 108/152, 37, 38, 57.17, 57.22, 57.31; 312/351; 211/187
See application file for complete search history.

(56) References Cited

U.S. PATENT DOCUMENTS 1,240,863 A * 9/1917 Lyda ..... A47H 1/142 248/224.7
3,333,555 A * 8/1967 Kapnek ..... A47B 96/066 108/108
3,565,020 A * 2/1971 Schier ..... A47B 96/028 108/152
3,752,088 A * 8/1973 Kapnek ..... A47B 5/02 108/152
3,837,605 A * 9/1974 Sicard ..... A47B 96/061 248/235
3,895,413 A * 7/1975 Buergers ..... E05D 5/02 16/382
5,265,971 A * 11/1993 Duc ..... F16B 12/12 108/152
5,845,453 A * 12/1998 Goya ..... E04B 1/2604 248/243
5,954,306 A * 9/1999 Hoover ..... A47B 96/027 108/108
6,164,610 A * 12/2000 Santiago ..... A47B 96/066 211/90.01
6,182,937 B1 * 2/2001 Sanderse ..... A47B 96/061 211/106.01
6,467,636 B1 * 10/2002 Schaefer ..... A47B 96/022 108/147.11

(Continued)

*Primary Examiner* — Terrell McKinnon
*Assistant Examiner* — Michael McDuffie
(74) *Attorney, Agent, or Firm* — Thorpe, North & Western, LLP

(57) ABSTRACT

The present application provides various examples of bracket for mounting a shelf to a flat vertical surface such as a wall. Examples and configurations disclosed herein provide brackets that have a high ratio of weight-supporting capacity to visibility relative to previous wall-mountable shelf-support apparatuses. One or more elongate members may extend through one or more apertures in a metal base. The proximal end(s) of the one or more elongate members may be welded to the back of the metal base around a cross-sectional perimeter of a cross-sectional shape that is shared by the proximal ends of the elongate members and the back ends of the apertures.

29 Claims, 8 Drawing Sheets

(56) References Cited

U.S. PATENT DOCUMENTS

| | | | | |
|---|---|---|---|---|
| 6,848,659 | B1 * | 2/2005 | Liu | A47B 47/024 108/147.13 |
| 8,082,859 | B2 * | 12/2011 | Sevack | A47B 96/066 108/152 |
| 8,602,372 | B2 * | 12/2013 | Yu | H05K 7/1489 211/192 |
| 8,689,519 | B2 * | 4/2014 | Zelich | A47B 97/00 248/231.9 |
| 9,185,979 | B1 * | 11/2015 | Jenks | A47B 96/066 |
| 2002/0104946 | A1 * | 8/2002 | Lai | A47K 10/04 248/316.8 |
| 2005/0127017 | A1 * | 6/2005 | Kessel | A47B 57/06 211/187 |
| 2008/0121146 | A1 * | 5/2008 | Burns | A47F 5/101 108/23 |
| 2009/0224119 | A1 * | 9/2009 | Heffernan | A47B 96/066 248/225.11 |
| 2013/0048584 | A1 * | 2/2013 | Kaperst | A47F 7/0035 211/60.1 |
| 2014/0217252 | A1 * | 8/2014 | Fitzgerald | A47B 57/50 248/218.4 |

* cited by examiner

BRACKET TO SUPPORT A SHELF

BACKGROUND

Shelves can be attached to walls using various support apparatuses, such as brackets. Some support apparatuses for wall-mounted shelves are able to support higher amounts of weight than others. Support apparatuses that are able to support higher amounts of weight tend to be bulkier and more visible than support apparatuses that support lower amounts of weight. A consumer may find a highly visible support apparatus on a wall to be undesirable in a room where the consumer wishes to establish a certain décor.

DETAILED DESCRIPTION

Figure 1A:
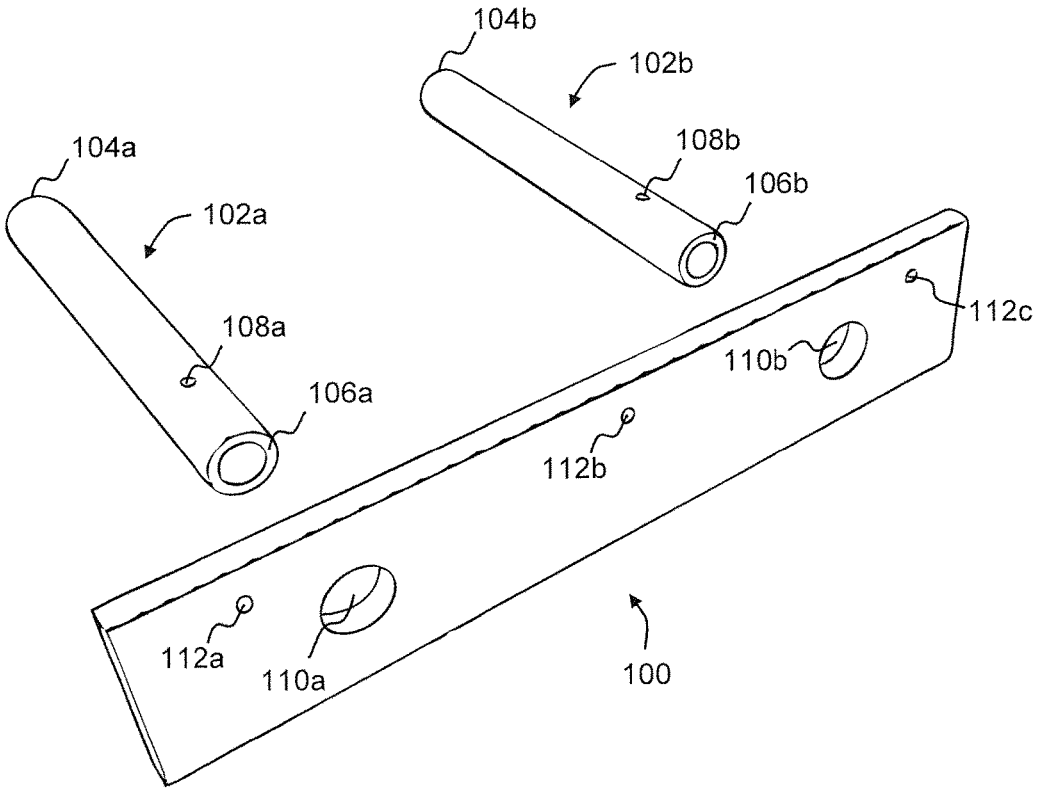
FIGS. 1*a-c* illustrate an example of how to construct a floating-shelf bracket in accordance with principles of the present disclosure.

Before some embodiments are disclosed and described, it is to be understood that the claimed subject matter is not limited to the particular structures, process operations, or materials disclosed herein, but is extended to equivalents thereof as would be recognized by those ordinarily skilled in the relevant arts. It should also be understood that terminology employed herein is used for the purpose of describing particular examples only and is not intended to be limiting. The same reference numerals in different drawings represent the same element. Numbers provided in flow charts and processes are provided for clarity in illustrating operations and do not necessarily indicate a particular order or sequence.

An initial overview of technology embodiments is provided below and then specific technology embodiments are described in further detail later. This initial summary is intended to aid readers in understanding the technology more quickly, but is not intended to identify key features or essential features of the technology nor is it intended to limit the scope of the claimed subject matter.

The present application relates provides various examples of bracket for mounting a shelf to a flat vertical surface such as a wall. Examples and configurations disclosed herein provide brackets that have a high ratio of weight-supporting capacity to visibility relative to previous wall-mountable shelf-support apparatuses.

When decorating a room, a consumer may wish to mount shelves to one or more walls in order to provide increased space for display or storage. Many wall-mountable shelf-support apparatuses (e.g., brackets) are commercially available. Many such brackets are mounted below the shelves they support and therefore remain visible beneath the shelves after installation is complete. Other varieties of shelf-support brackets are mounted above the shelves they support, but likewise remain visible after installation is complete.

Some consumers may wish to mount a shelf to a wall, but may not wish for the bracket that supports the shelf to be conspicuously visible. A shelf that is supported by a bracket that is not conspicuously visible is sometimes referred to as a floating shelf, since the shelf may appear to float due to the low visibility of the supporting bracket.

A number of supporting brackets for floating shelves are commercially available. However, there is often a tradeoff between visibility and weight-supporting strength because a bracket that is less conspicuous tends to be smaller and tends to absorb the stress of weight borne by a shelf over a smaller area. Consequently, consumers who wish to store or display relatively heavy items on floating shelves may have difficulty finding brackets that provide both a desired high level of weight-bearing capacity and a desired low level of bracket visibility.

Brackets designed in accordance with the design principles described in the present disclosure provide a high ratio of weight-supporting capacity to visibility relative to existing commercial support brackets for floating shelves. In one example, a bracket for supporting a shelf may comprise a base with a flat back side, an aperture extending through the base, and an elongate member that extends through the base via the aperture. The elongate member may be made of steel or another metal. A proximal end of the elongate member can be joined to the flat back side of the base at a back end of the aperture. In particular, the base and the elongate member can be made of metal and the back end of the aperture can form a cross-sectional shape; the proximal end of the elongate member can also form this same cross-sectional shape. The proximal end of the elongate member can be joined to the flat back side of the base by a weld that extends along a shared (i.e., by the proximal end of the elongate member and by the back end of the aperture) cross-sectional perimeter of the cross-sectional shape at the back end of the aperture. The weld can fully encompass the shared cross-sectional perimeter. When the elongate member is positioned in the aperture in the base and the proximal end of the elongate member is joined to the flat back side of the base (e.g., by a weld), a bracket with increased weight-bearing capacity results. By contrast, a bracket with an elongate member that is merely spot welded to the front side of the base would have comparably less weight-bearing capacity.

As a practical matter, in order to ensure that the proximal end of the elongate member can fit into the aperture, there may be a small amount of clearance between the cross-sectional shape formed by the proximal end of the elongate member and the cross-sectional shape formed by the aperture. For the purposes of this disclosure, however, if the largest clearance between the cross-sectional shape formed by the proximal end of the elongate member and the cross-sectional shape formed by the aperture is relatively small (e.g., smaller than one sixteenth of an inch) when the proximal end is positioned in the aperture, the proximal end of the elongate member and the aperture will still be considered to share a cross-sectional shape and a cross-sectional perimeter. For example, if an aperture and the proximal end of a pole (that is an elongate member) both have a cross-sectional shape of a circle and the difference between the cross-sectional diameter of the aperture and the cross-sectional diameter of the pole is less than one sixteenth of an inch, the cross-sectional diameter of the aperture and the cross-sectional diameter of the pole may be considered to be substantially equal.

The bracket may also comprise one or more apertures for fasteners. The one or more apertures for fasteners can extend through a front side of the base and through the back side of the base. In other words, the apertures for fasteners can pass completely through the base. The apertures for fasteners may be vacuous apertures. The apertures for fasteners may be positioned closer to the top side of the base than to the bottom side of the base. Fasteners, such as screws (e.g., wood screws), bolts (e.g., carriage bolts or lag bolts), anchors (e.g., masonry anchors or drywall anchors), or nails, may be inserted through the one or more apertures for fasteners and into a wall in order to secure the bracket to the wall with the flat back side of the base pressed against the wall and the front side of the base facing away from the wall. The bracket may be mounted in an upright orientation such that the top side of the bracket is oriented upward and the bottom side of the bracket is oriented downward.

A distal end of the elongate member may extend outwardly from the front side of the base. Specifically, the distal end of the elongate member may extend outwardly from the front side of the base in a direction that is substantially orthogonal to a plane formed by the flat back side of the base. Hence, when the bracket is mounted, the elongate member may extend outwardly from the front side of the base in a direction that is substantially orthogonal to a plane formed by the wall.

The elongate member may also comprise an aperture for a fastener. A shelf with a channel to receive the elongate member can be slid onto the elongate member until the shelf contacts the front side of the base or until the distal end of the elongate member contacts an end of the channel. The shelf may have an aperture for a fastener that lines up with the elongate member's aperture for a fastener when the shelf is properly situated on the elongate member so that a fastener can be inserted through the shelf's aperture and the elongate member's aperture in order to secure the shelf to the elongate member.

The base may form a rectangular prism. The width of the rectangular prism formed by the base can be greater than the height of the rectangular prism, while the height of the rectangular prism may be greater than the depth of the rectangular prism.

Optionally, the width of the base may be no greater than the width of the shelf and the height of the bracket may be no greater than the height of the shelf in order to reduce visibility of the bracket when the shelf is secured to the wall using the bracket.

Figure 1B:
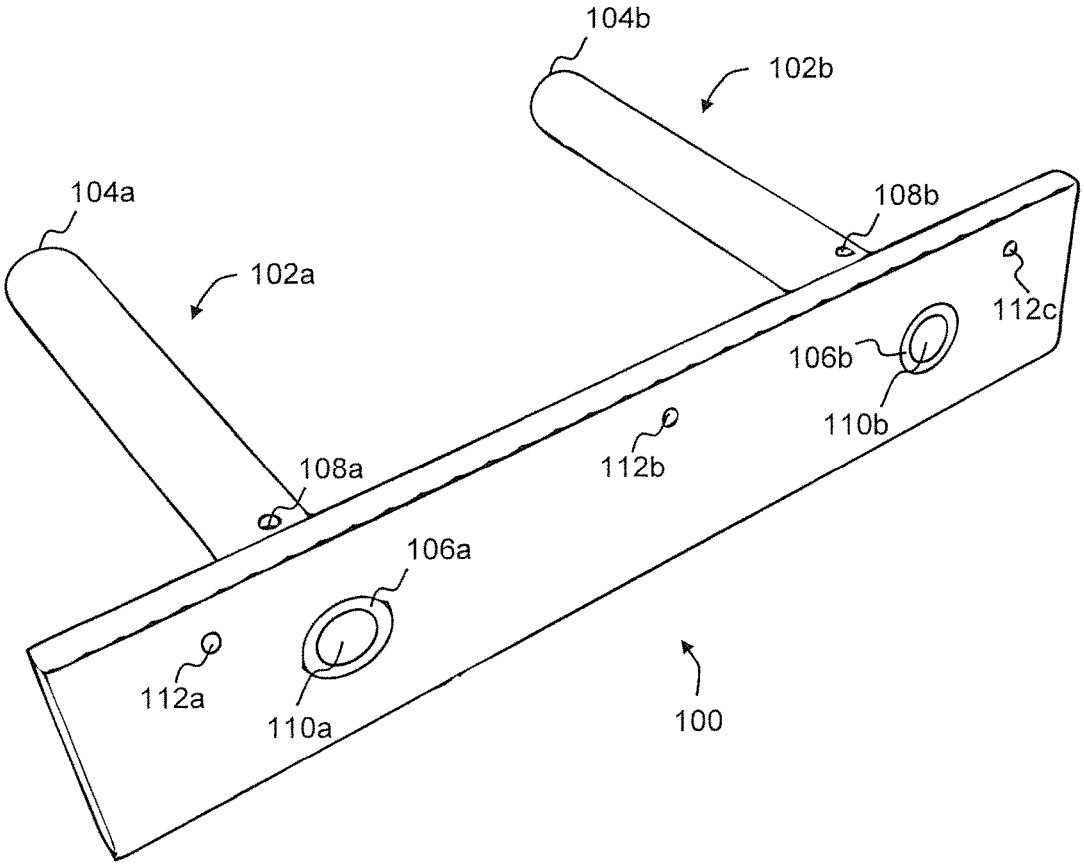
Figure 1C:
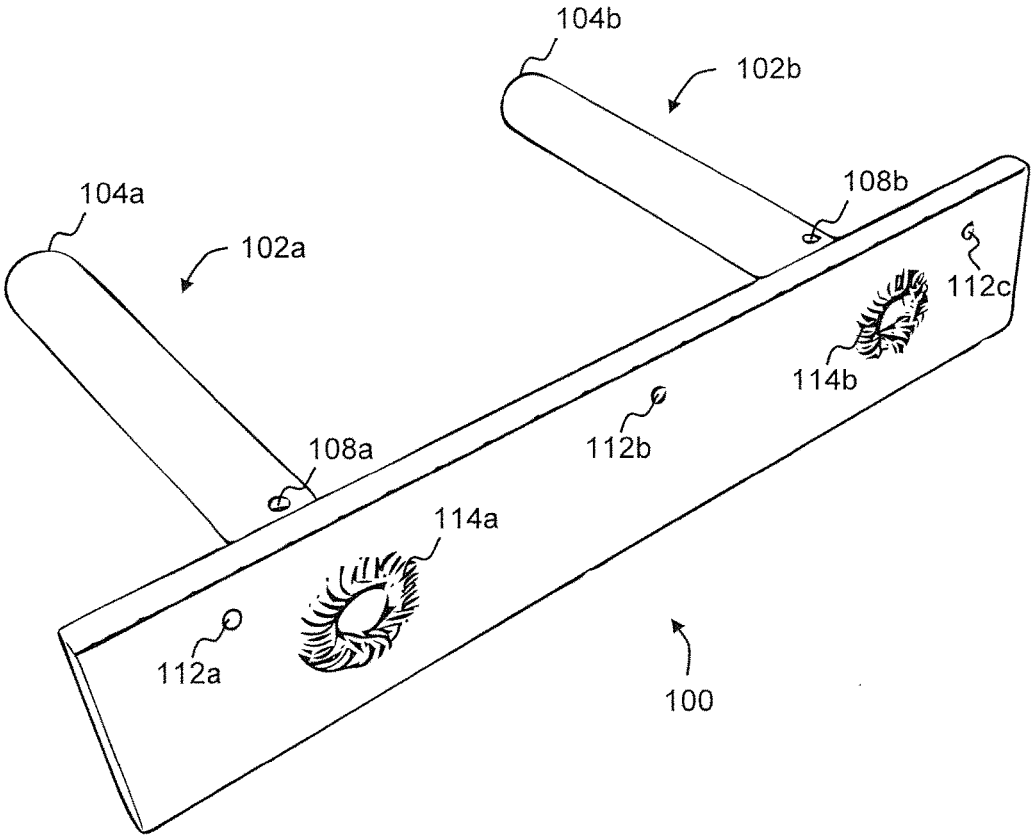

FIGS. 1*a-c* illustrate an example of how to construct a floating-shelf bracket in accordance with principles of the present disclosure. FIG. 1*a* shows a back view of a base 100. As shown, the base 100 may form a rectangular prism wherein the width is greater than the height and the height is greater than the depth. The base 100 may comprise apertures 110*a* and 110*b* configured to accommodate the proximal ends 106*a* and 106*b* of elongate members 102*a* and 102*b*, respectively. The base 100 may also comprise apertures 112*a-c* through which fasteners can be inserted in order to secure the base 100 to a wall. As shown, the apertures 112*a-c* may be closer to the top side of the base 100 than to the bottom side of the base 100. The distal ends 104*a* and 104*b* of the elongate members 102*a* and 102*b* can be oriented away from the base 100. The elongate members 102*a* and 102*b* can comprise apertures 108*a* and 108*b*, respectively, through which fasteners may be inserted to secure to elongate members 102*a* and 102*b* to a shelf. The apertures 108*a* and 108*b* can extend radially into the elongate members 102*a* and 102*b*, respectively.

While FIGS. 1*a-c* show an example that includes two elongate members, other numbers of elongate members may be used. For example, some embodiments can include a single elongate member, while other embodiments can include three or more elongate members. There can be a respective aperture for each elongate member in the base.

FIG. 1*b* illustrates positions and orientations of the base 100 and the elongate members 102*a-b* that can be established before the elongate members 102*a-b* are joined to the base 100 (e.g., by welding). As shown in FIG. 1*b*, the proximal ends 106*a-b* of the elongate members can be inserting into the apertures 110*a-b*, respectively, such that the proximal ends 106*a-b* approximately line up with the back side of the base 100. Hence, the full depth of the apertures 110*a-b* can be occupied by the elongate members 102*a-b*. As shown in FIG. 1*b*, the distal ends 104*a* and 104*b* of the elongate members 102*a* and 102*b* may extend outwardly from the front side of the base 100 in a direction that is substantially orthogonal to a plane formed by the flat back side of the base 100.

The apertures 110*a-b* and the proximal ends 106*a-b* may both have a cross-sectional shape that is circular or substantially circular (though other cross-sectional shapes can be used in other embodiments). As a result, the apertures 110*a-b* and the proximal ends 106*a-b* may fit relatively tightly with minimal clearance throughout the perimeter of the cross-sectional shape. The proximal ends 106*a-b* of the elongate members 102*a-b* can be joined to the base 100 at the back of the base 100 around part or all of the cross-sectional perimeter that is shared with the apertures 110*a-b*, respectively.

In FIG. 1*b*, the elongate members 102*a-b* are cylindrical poles and the apertures 110*a-b* are cylindrical such that the cross-sectional diameter of the elongate members 102*a-b* is substantially equal to a cross-sectional diameter of the apertures 110*a-b*. However, in other embodiments, elongate members that are not cylindrical can be used. Furthermore, elongate members (and the respective apertures into which they fit) need not be identical to each other.

Unlike the apertures 110*a-b* (which accommodate the elongate members 102*a-b*), the apertures 108*a* and 108*b* and the apertures 112*a-c* can be vacuous (i.e., unfilled with other parts of the bracket) so that fasteners can be inserted therein.

FIG. 1*c* illustrates an embodiment in which the proximal ends 106*a-b* (shown in FIGS. 1*a-b*) are joined to the base 100 at the back of the base 100 around the cross-sectional perimeter that is shared with the apertures 110*a-b* using welds 114*a* and 114*b*, respectively. Since the cross-sectional perimeter of the apertures 110*a-b* is circular, the welds 114*a* and 114*b* can be circumferential. As shown, the welds 114*a* and 114*b* can traverse the entire cross-sectional perimeter (e.g., circumference) of the apertures 110*a* and 110*b*, respectively, thereby encompassing the cross-sectional perimeter. The extension of the elongate members 102*a-b* through the base and the position of the welds 114*a* and 114*b* on the back of the base 100 enable the elongate members 102*a-b* to support a more shelf weight than brackets in which elongate members are merely spot-welded to the front of a base.

Figure 2A:
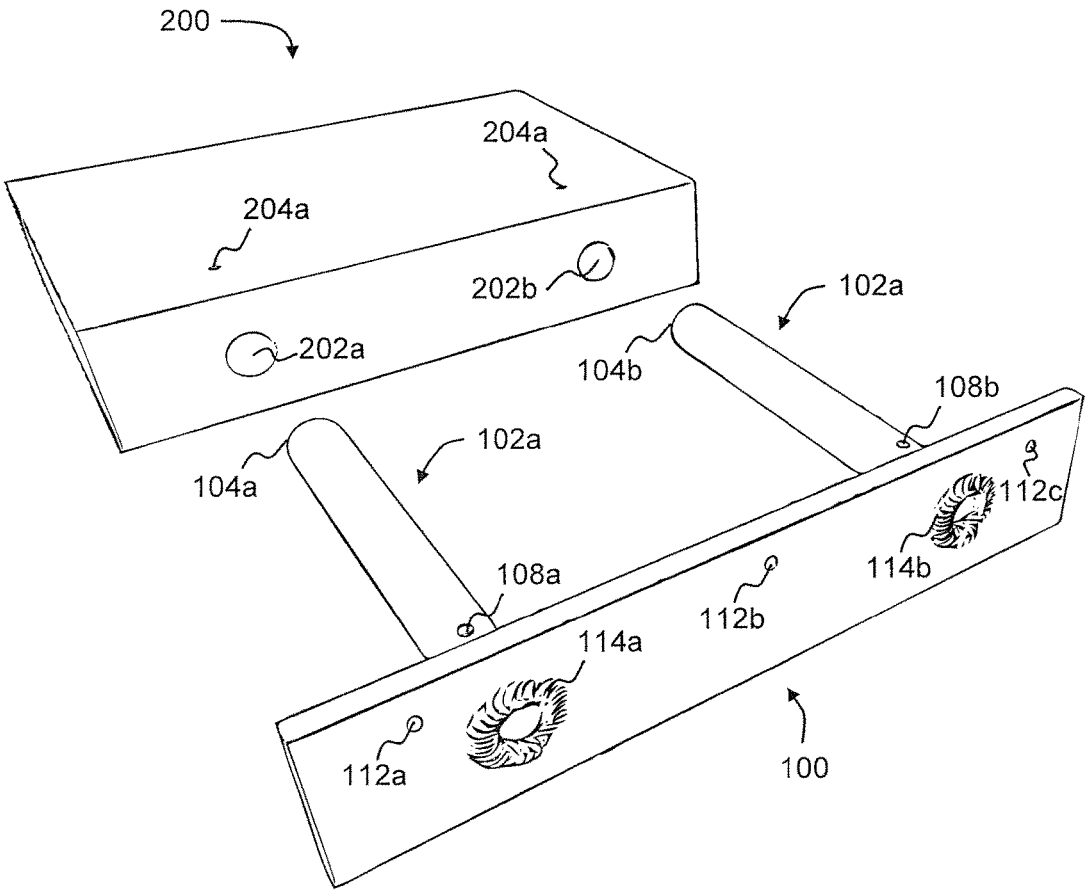
FIGS. 2*a-b* illustrate an example of how to attach a shelf to the elongate members of a metal bracket for a floating shelf.
Figure 2B:
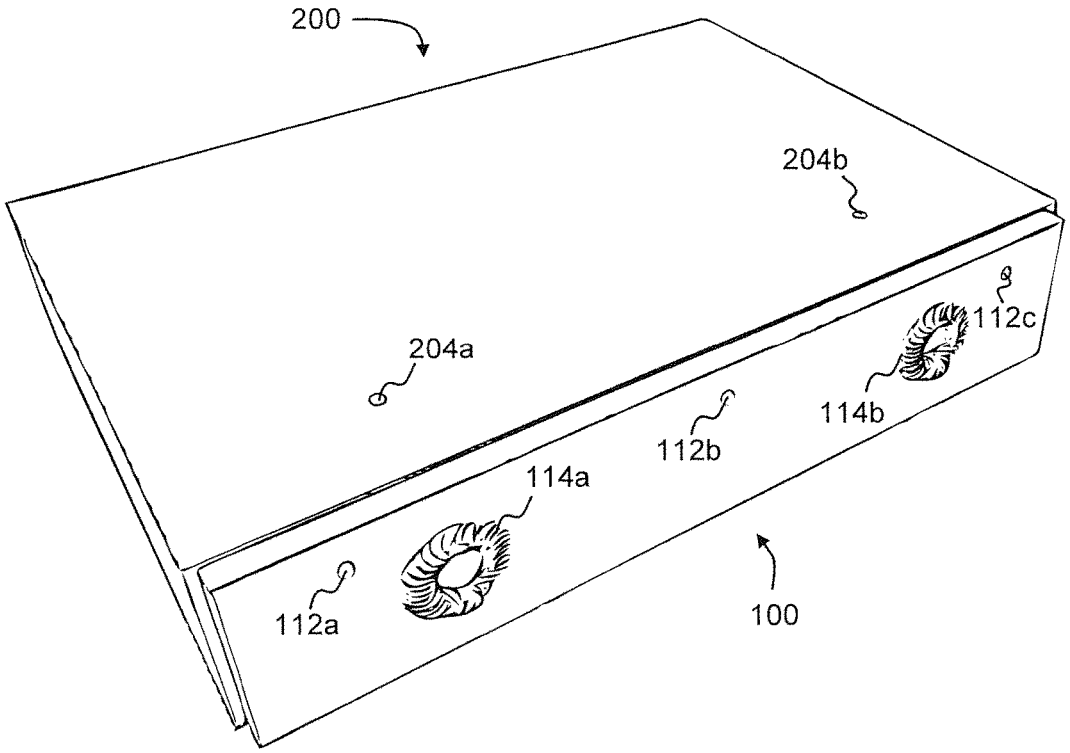

FIGS. 2*a-b* illustrate an example of how to attach a shelf 200 to the elongate members 102*a-b*. FIG. 2*a* illustrates a shelf 200 before the shelf is installed. The shelf 200 can comprise holes 202*a* and 202*b* that are deep enough to accommodate the elongate members 102*a* and 102*b*, respectively. The shelf can also comprise apertures 204*a-b*. The elongate members 102*a* and 102*b* can be slid into the holes 202*a* and 202*b*, resulting in the view shown in FIG. 2*b*.

FIG. 2*b* illustrates a view of the shelf 200 that results when the elongate members 102*a* and 102*b* are slid into the holes 202*a* and 202*b*. As shown in FIG. 2*b*, the width of the base 100 may be less than or equal to the width of the shelf 200 and the height of the base 100 may be less than or equal to the height of the shelf 200 in order to reduce the visibility of the base 100 after mounting to a wall is complete. The apertures 204*a* and 204*b* can be aligned with the apertures 108*a* and 108*b* (shown in FIG. 2*a*) so that fasteners inserted into the apertures 204*a* and 204*b* can also extend into the apertures 108*a* and 108*b*, respectively, thereby securing the shelf 200 to the elongate members 108*a* and 108*b*.

Figure 3A:
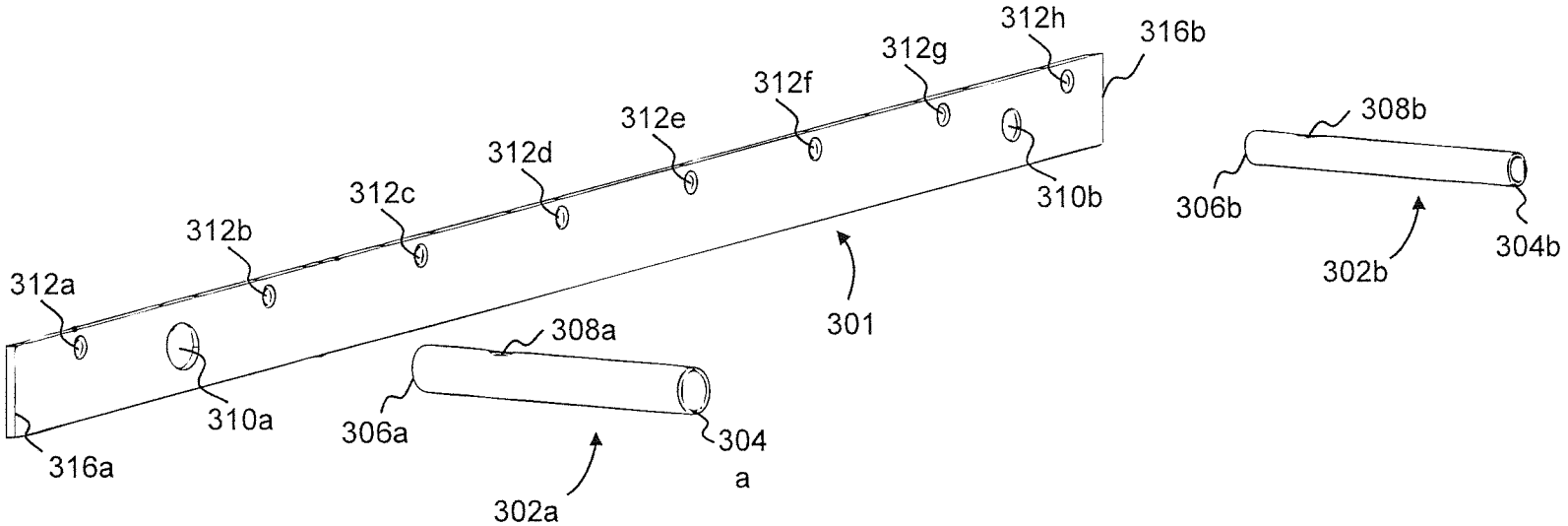
FIGS. 3*a-c* illustrate another example of a bracket for a floating shelf as seen from different views.
Figure 3B:
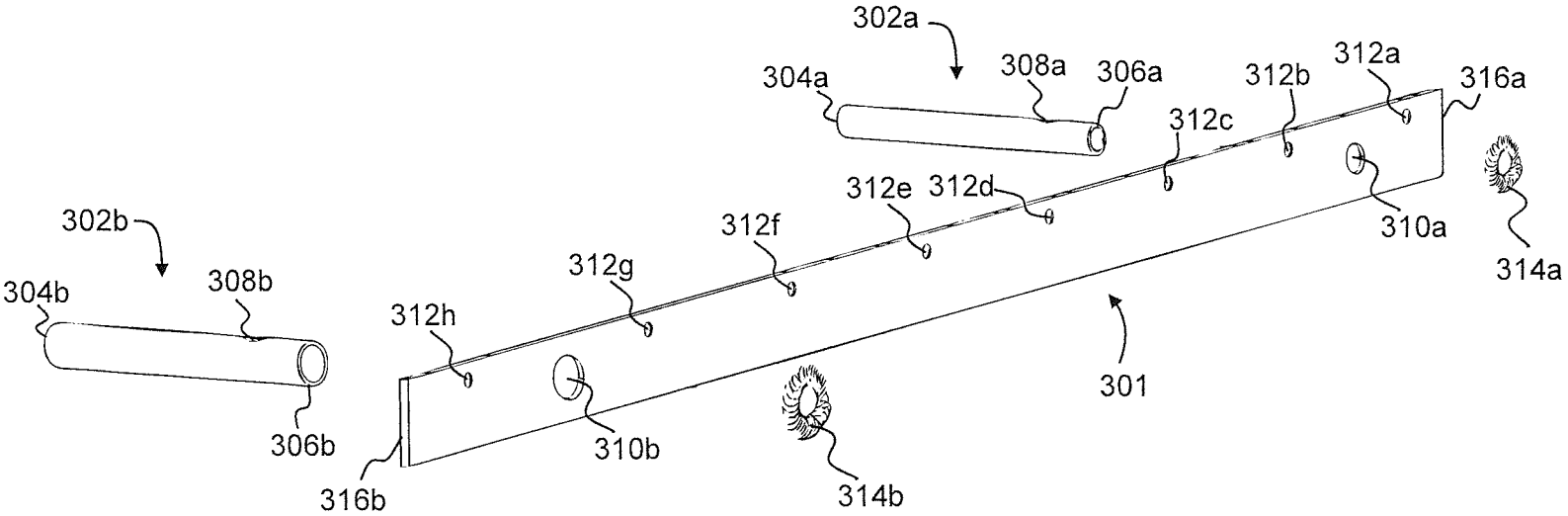
Figure 3C:
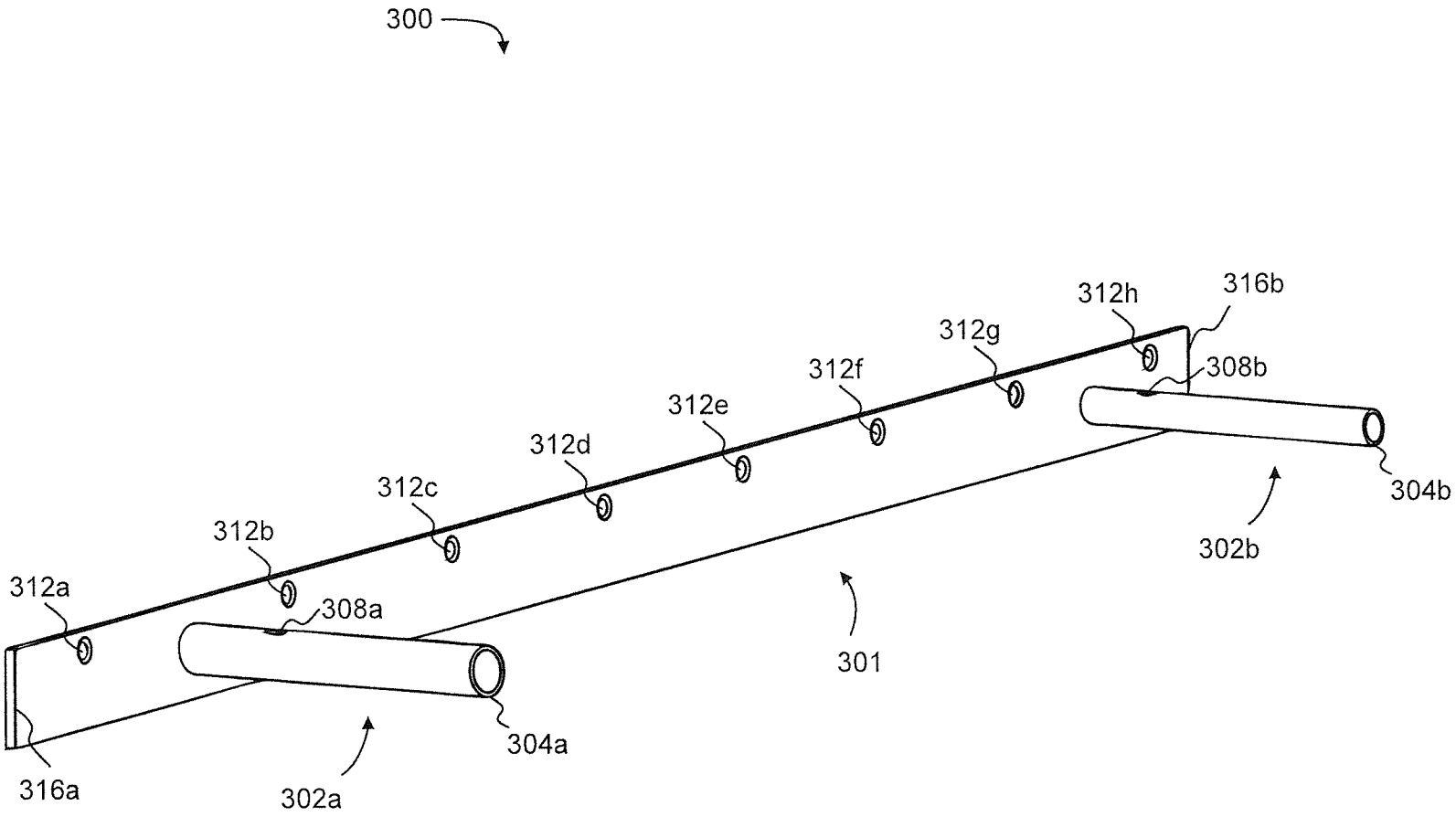

FIGS. 3*a-c* illustrate another embodiment from different views. FIG. 3*a* shows an exploded frontal view of a metal base 301 and elongate members 302*a-b* of a bracket 300 (shown assembled in FIG. 3*c*) for a floating shelf.

The metal base 301 may be a hot-rolled steel flat bar that is ¼" (i.e., one fourth of one inch) thick. The metal base 301 can comprise circular apertures 310*a-b* that are configured to fit the elongate members 302*a-b*. The circular apertures 310*a-b* can be vertically centered on relative to the metal base 301 and can therefore be level with each other relative to the height of the metal base 301. The circular aperture 310*a* may be set two inches on center (OC) from the end 316*a* of the metal base 301. The circular aperture 310*b* may be set two inches on center (OC) from the end 316*b* of the metal base 301. The circular apertures 310*a-b* may be have an outside diameter (OD) of 49/64" (i.e., forty-nine sixty-fourths of an inch) and may be punched through the metal base 301.

The metal base 301 may also contain apertures 312*a-h* for fasteners. The apertures 312*a-h* may be countersunk screw holes with a diameter of 3/16" (i.e., three sixteenths of an inch). The apertures 312*a-h* may also be closer to the top of the metal bracket 301 than to the bottom of the metal bracket 301. The aperture 312*a* may be set 1" (i.e., one inch) on center (OC) from the end 316*a* of the metal base 301. The aperture 312*b* may be set 1" (i.e., one inch) on center (OC) from the end 316*b* of the metal base 301. The aperture 316*b* may be set 4" (i.e., four inches) OC from the aperture 316*a*. The aperture 316*c* may be set 4" (i.e., four inches) OC from the aperture 316*b*. The aperture 316*d* may be set 4" OC from the aperture 316*c*. The aperture 316*e* may be set 4" OC from the aperture 316*d*. The aperture 316*e* may be set 4" OC from the aperture 316*d*. The aperture 316*f* may be set 4" OC from the aperture 316*e*. The aperture 316*g* may be set 4" (i.e., four inches) OC from the aperture 316*f* (and also 4" from the aperture 316*h*). Thus, the apertures 316*a-h* may be evenly spaced relative to each other across the width of the metal base 301.

The elongate members 302*a-b* may be 6.25 inches long and may be metal or steel rods or 0.120 gauge (GA) metal or steel pipes with a diameter of ¾" (i.e., three quarters of an inch). The elongate members 302*a-b* may comprise apertures 308*a-b* for fasteners that may be used to secure the elongate members 302*a-b* (and therefore the metal bracket 300) to a shelf. The apertures 308*a-b* may extend radially into the elongate members 302*a-b*, respectively, and may have a diameter of 3/16" (i.e., three sixteenths of an inch). Hence, the diameter of the elongate members 302*a-b* may be slightly smaller than the diameter of the apertures 308*a-b* so that there is a small clearance (e.g., less than two hundredths of an inch), but the elongate members 302*a-b* and the apertures 308*a-b* may still be considered to share a cross-sectional shape (a circle) and a cross-sectional perimeter for the purposes of this disclosure. The apertures 308*a-b* may also be located 1.25 inches on center (OC) from proximal ends 306*a-b* of the elongate members 302*a-b* that are opposite the distal ends 304*a-b* of the elongate members 302*a-b*. The apertures 308*a-b* may also extend through all or part of elongate members 302*a-b*.

FIG. 3*b* illustrates an exploded rear view of the metal base 301 and the elongate members 302*a-b*. For clarity, the exploded rear view provided by FIG. 3*b* shows the welds 314*a-b* as being separate from the metal base 301 and the elongate members 302*a-b*. However, it is to be understood that the welds 314*a-b* are actually formed when the proximal ends 306*a-b* of the elongate members 302*a-b* are welded to the back side of the metal base 301 around the back ends of the apertures 310*a-b*. As the apertures 310*a-b* and the proximal ends 306*a-b* have a shared cross-sectional shape that is circular, the welds 314*a-b* can be circumferential. Furthermore, the welds 314*a-b* can traverse the entire perimeter of the shared cross-sectional circular shape. In other words, the welds 314*a-b* can extend 360 degrees (27π radians) around the cross-sectional perimeters of the apertures 310*a-b*, respectively, thereby joining the proximal ends 306*a-b* of the elongate members 302*a-b* to the back of the metal base 301.

FIG. 3*c* illustrates a frontal assembled view of the metal bracket 300. As shown, the distal ends 304*a-b* elongate members can extend outwardly from the front side of the metal base 301 in a direction that is orthogonal (or substantially orthogonal) to a plane formed by a plane formed by the back side of the metal base.

Reference was made to the examples illustrated in the drawings, and specific language was used herein to describe the same. It will nevertheless be understood that no limitation of the scope of the technology is thereby intended. Alterations and further modifications of the features illustrated herein, and additional applications of the examples as illustrated herein, which would occur to one skilled in the relevant art and having possession of this disclosure, are to be considered within the scope of the description.

Furthermore, the described features, structures, or characteristics may be combined in any suitable manner in one or more examples. In the preceding description, numerous specific details were provided, such as examples of various configurations to provide a thorough understanding of examples of the described technology. One skilled in the relevant art will recognize, however, that the technology can be practiced without one or more of the specific details, or with other methods, components, devices, etc. In other instances, well-known structures or operations are not shown or described in detail to avoid obscuring aspects of the technology.

Although the subject matter has been described in language specific to structural features and/or operations, it is to be understood that the subject matter defined in the appended claims is not necessarily limited to the specific features and operations described above. Rather, the specific features and acts described above are disclosed as example forms of implementing the claims. Numerous modifications and alternative arrangements can be devised without departing from the spirit and scope of the described technology.

What is claimed is:

1. A metal bracket for a floating shelf, the metal bracket comprising:

a metal base with a planar back side configured to press against a wall;

a plurality of circular apertures, each aperture extends through a front side of the metal base and through the back side of the metal base;

a plurality of metal pipes, each respective metal pipe extends completely through the metal base via a respective circular aperture to the planar back side; and a plurality of circumferential welds, each joining a proximal axial end of each respective metal pipe to the planar back side of the metal base around a perimeter of the respective circular aperture; wherein the plurality of circumferential welds is locate at the planar back side of the base.

2. The metal bracket of claim 1, wherein the metal bracket further comprises a plurality of vacuous apertures for fasteners, wherein the vacuous apertures for fasteners extend through the metal base.

3. The metal bracket of claim 2, wherein the plurality of vacuous apertures for fasteners are positioned closer to a top side of the metal base than to a bottom side of the metal base.

4. The metal bracket of claim 1, wherein each respective metal pipe extends outwardly from the front side of the metal base in a direction that is substantially orthogonal to a plane formed by the planar back side.

5. The metal bracket of claim 1, wherein the metal base forms a rectangular prism, wherein a width of the rectangular prism is greater than a height of the rectangular prism and the height of the rectangular prism is greater than a depth of the rectangular prism.

6. The metal bracket of claim 1, wherein a cross-sectional outer radius of each respective metal pipe at the proximal axial end of the respective metal pipe is substantially equal to a radius of the respective aperture through which the respective metal pipe extends.

7. The metal bracket of claim 1, wherein each respective metal pipe is circumferentially welded to the planar back side of the metal base for 360 degrees ($2\pi$ radians) around the perimeter of the respective circular aperture.

8. The metal bracket of claim 1, wherein each respective metal pipe comprises a vacuous aperture for a fastener, the aperture for a fastener extending radially into the respective metal pipe.

9. The metal bracket of claim 1, wherein a width of the metal bracket is no greater than a width of the floating shelf and a height of the metal bracket is no greater than a height of the floating shelf so that the bracket can be minimally visible when the floating shelf is secured to a wall using the bracket.

10. A bracket for supporting a shelf, the bracket comprising:

a base with a flat back side configured to press against a wall;

an aperture extending through the base; and an elongate member that extends completely through the base via the aperture, wherein a proximal end of the elongate member is joined to the flat back side of the base at a back end of the aperture.

11. The bracket of claim 10, wherein the bracket further comprises one or more apertures for fasteners, wherein the one or more apertures for fasteners extend through a front side of the base and through the back side of the base.

12. The bracket of claim 11, wherein the one or more apertures are positioned closer to a top side of the base than to a bottom side of the base.

13. The bracket of claim 10, wherein the elongate member extends outwardly from a front side of the base in a direction that is substantially orthogonal to a plane formed by the flat back side.

14. The bracket of claim 10, wherein the base forms a rectangular prism, wherein a width of the rectangular prism is greater than a height of the rectangular prism and the height of the rectangular prism is greater than a depth of the rectangular prism.

15. The bracket of claim 10, wherein:

the back end of the aperture forms a cross-sectional shape;

the proximal end of the elongate member also forms the cross-sectional shape; and the proximal end of the elongate member is joined to the flat back side of the base by a weld, wherein the weld extends along a shared cross-sectional perimeter of the cross-sectional shape at the back end of the aperture.

16. The bracket of claim 15, wherein the weld fully encompasses the shared cross-sectional perimeter.

17. The bracket of claim 10, wherein the elongate member comprises an aperture for a fastener, the aperture for the fastener extending into the elongate member.

18. The bracket of claim 10, wherein a width of the base is no greater than a width of the shelf and a height of the base is no greater than a height of the shelf in order to reduce visibility of the bracket when the shelf is secured to a surface using the bracket.

19. A bracket for a floating shelf, the bracket comprising:

a base with a planar back side configured to press against a wall;

a plurality of apertures extending through the base; and a plurality of poles, wherein each respective pole extends completely through the base via a respective aperture and a proximal end of each respective pole is joined to the planar back side of the base around a cross-sectional perimeter of the respective aperture.

20. The bracket of claim 19, wherein the proximal end of each respective pole is joined to the planar back side of the base by a weld, wherein the weld spans across an entire shared cross-sectional perimeter of the respective pole and the respective aperture.

21. The bracket of claim 19, wherein each respective pole is cylindrical and the respective aperture is cylindrical, and wherein a cross-sectional diameter of the respective pole is substantially equal to a cross-sectional diameter of the respective aperture.

22. The bracket of claim 21, wherein each respective pole comprises an aperture for a fastener, the aperture extending radially into the respective pole.

23. The bracket of claim 19, wherein the bracket further comprises a plurality of apertures for fasteners, wherein each aperture extends through the base in a direction substantially orthogonal to a plane formed by the planar back side of the base.

24. The bracket of claim 23, wherein the plurality of apertures are positioned closer to a top side of the base than to a bottom side of the base.

25. The bracket of claim 19, wherein the apertures are level with each other relative to a height of the base and are evenly spaced relative to each other across a width of the base.

26. The bracket of claim 10, wherein the flat back side of the base is a rear-most surface of the base; and wherein the elongate member extends completely through the aperture from a front of the base to the flat back side of the base.

27. The bracket of claim 10, wherein the base is solid.

28. The bracket of claim 10, wherein the proximal end of the elongate member is flush with the flat back side of the base.

29. The bracket of claim 10, wherein the elongated member has a constant shape and width through the aperture.

* * * * *